US008061833B2

(12) United States Patent
Onozawa et al.

(10) Patent No.: US 8,061,833 B2
(45) Date of Patent: Nov. 22, 2011

(54) INKJET PRINTER, PRINTING METHOD AND INK DRYER

(75) Inventors: Yoshiki Onozawa, Tomi (JP); Ryuji Yamada, Tomi (JP); Teruhisa Takano, Kobe (JP)

(73) Assignee: Mimaki Engineering Co., Ltd., Nagano (JP)

( * ) Notice: Subject to any disclaimer, the term of this patent is extended or adjusted under 35 U.S.C. 154(b) by 322 days.

(21) Appl. No.: 12/487,139

(22) Filed: Jun. 18, 2009

(65) Prior Publication Data

US 2009/0322841 A1 Dec. 31, 2009

(30) Foreign Application Priority Data

Jun. 26, 2008 (JP) ..... 2008-167617

(51) Int. Cl.
*B41J 2/01* (2006.01)

(52) U.S. Cl. ..... 347/102

(58) Field of Classification Search ..... 347/101, 347/102, 104; 34/248, 259, 273, 274; 219/687, 219/695

See application file for complete search history.

(56) References Cited

U.S. PATENT DOCUMENTS

| | | | | |
|---|---|---|---|---|
| 5,296,873 | A * | 3/1994 | Russell et al. | 346/25 |
| 5,412,411 | A * | 5/1995 | Anderson | 347/28 |
| 5,422,463 | A * | 6/1995 | Gooray et al. | 219/694 |
| 6,590,191 | B2 * | 7/2003 | Drozd et al. | 219/695 |

FOREIGN PATENT DOCUMENTS

JP 2003-022890 1/2003

* cited by examiner

*Primary Examiner* — Anh T. N. Vo

(74) *Attorney, Agent, or Firm* — Ditthavong Mori & Steiner, P.C.

(57) ABSTRACT

An inkjet printer includes an inkjet head, an electromagnetic-wave supplier, a wave guide, and a ventilator. The inkjet head is configured to eject ink onto a surface of a medium. The electromagnetic-wave supplier is configured to generate electromagnetic waves. The wave guide has an internal space into which the medium is to be fed. The wave guide is connected to the electromagnetic-wave supplier to apply the electromagnetic waves to the medium. The ventilator is configured to flow a gas in the internal space of the wave guide.

4 Claims, 6 Drawing Sheets

INKJET PRINTER, PRINTING METHOD AND INK DRYER

CROSS-REFERENCE TO RELATED APPLICATIONS

This application claims priority under 35 U.S.C. §119 to Japanese Patent Application No. 2008-167617, filed Jun. 26, 2008. The contents of this application are incorporated herein by reference in their entirety.

BACKGROUND OF THE INVENTION

1. Field of the Invention

The present invention relates to an inkjet printer, a printing method, and an ink dryer for the inkjet printer.

2. Discussion of the Background

In an inkjet printer, printing is conducted by ejecting dye-type ink such as acid dye, reactive dye, and substantive dye or pigment-type ink containing organic solvent such as solvent ink, onto a surface or both front and back surfaces of a sheet-like medium (recording medium) made of paper, silk, cotton, vinyl chloride, or the like. Especially in the industrial field, in such an inkjet printer, it is important to effectively dry a medium after deposition of ink onto the medium in order to quickly and easily conduct shipment and delivery after printing.

For example, JP-A-2003-22890 discloses a drying apparatus for drying ink on a medium. The drying apparatus includes a wave guide having a slot, which is configured to allow the medium to move through the slot, and an electromagnetic energy source, which is adapted to establish an electric field within the wave guide such that an angle formed between a direction of the electric field and a longitudinal axis of fibers of the medium becomes greater than ten degrees and less than or equal to ninety degrees.

SUMMARY OF THE INVENTION

According to one aspect of the present invention, an inkjet printer includes an inkjet head, an electromagnetic-wave supplier, a wave guide, and a ventilator. The inkjet head is configured to eject ink onto a surface of a medium. The electromagnetic-wave supplier is configured to generate electromagnetic waves. The wave guide has an internal space into which the medium is to be fed. The wave guide is connected to the electromagnetic-wave supplier to apply the electromagnetic waves to the medium. The ventilator is configured to flow a gas in the internal space of the wave guide.

According to another aspect of the present invention, a printing method includes ejecting ink onto a surface of a medium. The medium is fed into a wave guide. The electromagnetic-wave is supplied to the wave guide to apply the electromagnetic waves to the medium which is fed into the wave guide. An inside of the wave guide is ventilated.

According to further aspect of the present invention, an ink dryer for an inkjet printer includes an electromagnetic-wave supplier, a wave guide, and a ventilator. The electromagnetic-wave supplier is configured to generate electromagnetic waves. The wave guide has an internal space into which a medium to be printed is to be fed. The wave guide is connected to the electromagnetic-wave supplier to apply the electromagnetic waves to the medium. The ventilator is configured to flow a gas in the internal space of the wave guide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
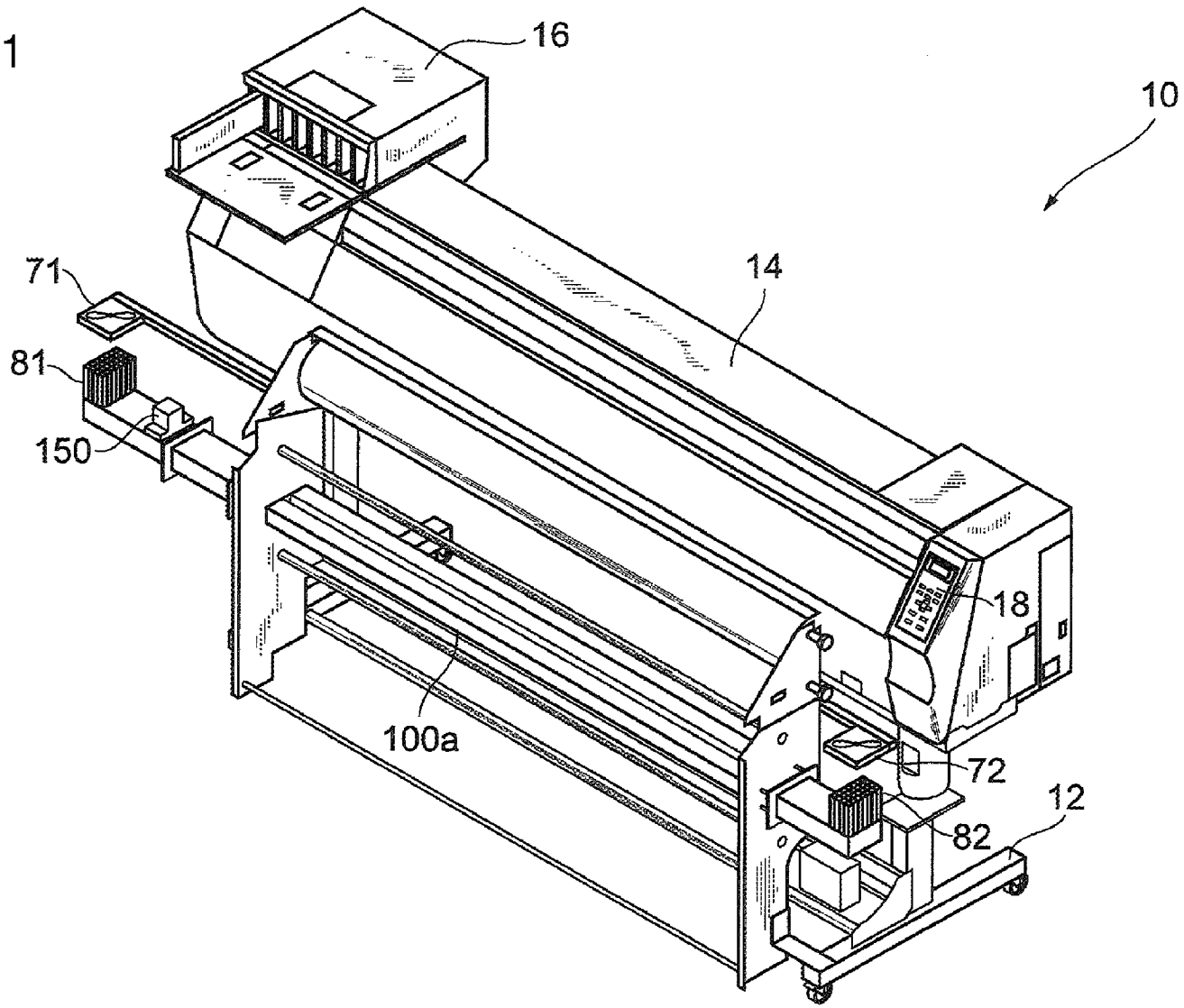
FIG. 1 is a perspective view showing an inkjet printer according to a first embodiment of the present invention.

Embodiments will now be described with reference to the accompanying drawings, wherein like reference numerals designate corresponding or identical elements throughout the various drawings.

FIG. 1 is a perspective view showing an inkjet printer according to a first embodiment of the present invention. As shown in FIG. 1, the inkjet printer 10 of this embodiment includes a printer unit 14 and a wave guide 100*a* which are mounted on a base 12. The printer unit 14 includes a toner section 16 in which inks of respective kinds to be ejected on a medium are stored and an operation section 18 by which a user conducts manipulated input. Attached to one end of the wave guide 100*a* is a magnetron 150 for supplying electromagnetic fields into the wave guide 100*a*.

On an end portion of the wave guide 100*a* where the magnetron 150 is attached, an air sending port 81 composed of a plurality of square tubes is disposed. Directly above the air sending port 81, an air sending fan 71 for sending air into the air sending port 81 is disposed. On an end portion of the wave guide 100*a* opposite to the end where the magnetron 150 is attached, an air suction port 82 composed of a plurality of square tubes is disposed. Directly above the air suction port 82, an air suction fan 72 for sucking air from the air suction port 82 is disposed.

Figure 2:
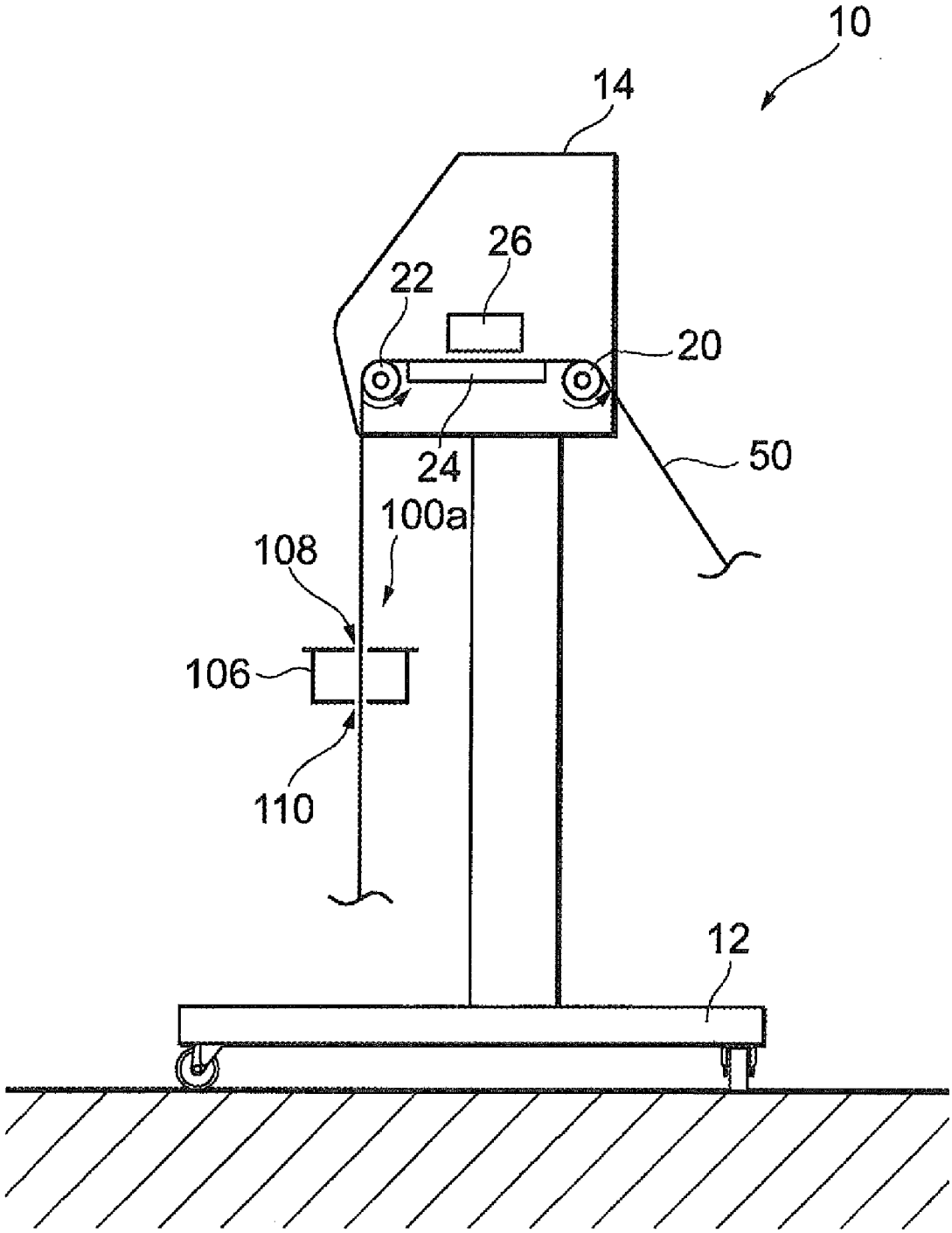
FIG. 2 is an illustration showing a state of printing and drying of a medium in the inkjet printer according to the first embodiment.

FIG. 2 is an illustration showing a state of printing and drying of a medium in the inkjet printer 10 according to the first embodiment. As shown in FIG. 2, in the inkjet printer 10 of this embodiment, a sheet-like medium 5, which is made of paper, silk, cotton, vinyl chloride or the like and is entered into the printer unit 14, is fed by rollers 20, 22. The medium 50 fed by the rollers 20, 22 is placed on a platen 24 where dye-type ink such as acid dye, reactive dye, and substantive dye or pigment-type ink containing organic solvent such as solvent ink is ejected from an inkjet head 26 onto a surface of the medium 50.

The medium 50 on which the ink was deposited is introduced into a wave guide body portion 106 through a medium introduction portion 108 of the wave guide 100*a*. Inside the wave guide body portion 106, electromagnetic waves are supplied from the magnetron 150 shown in FIG. 1. The electromagnetic waves supplied by the magnetron 150 are microwaves having a wavelength of from 100 μm to 1 m and a frequency of from 300 MHz to 3 THz, preferably, a wavelength of from 0.075 m to 0.15 m and a frequency of from 2 GHz to 4 GHz. In the wave guide body portion 106 into which electromagnetic waves are supplied, the ink deposited on the medium 50 is dried. The medium 50 entered into the wave guide body portion 106 is led out of the wave guide body portion 106 through a medium exit portion 110.

Figure 3:
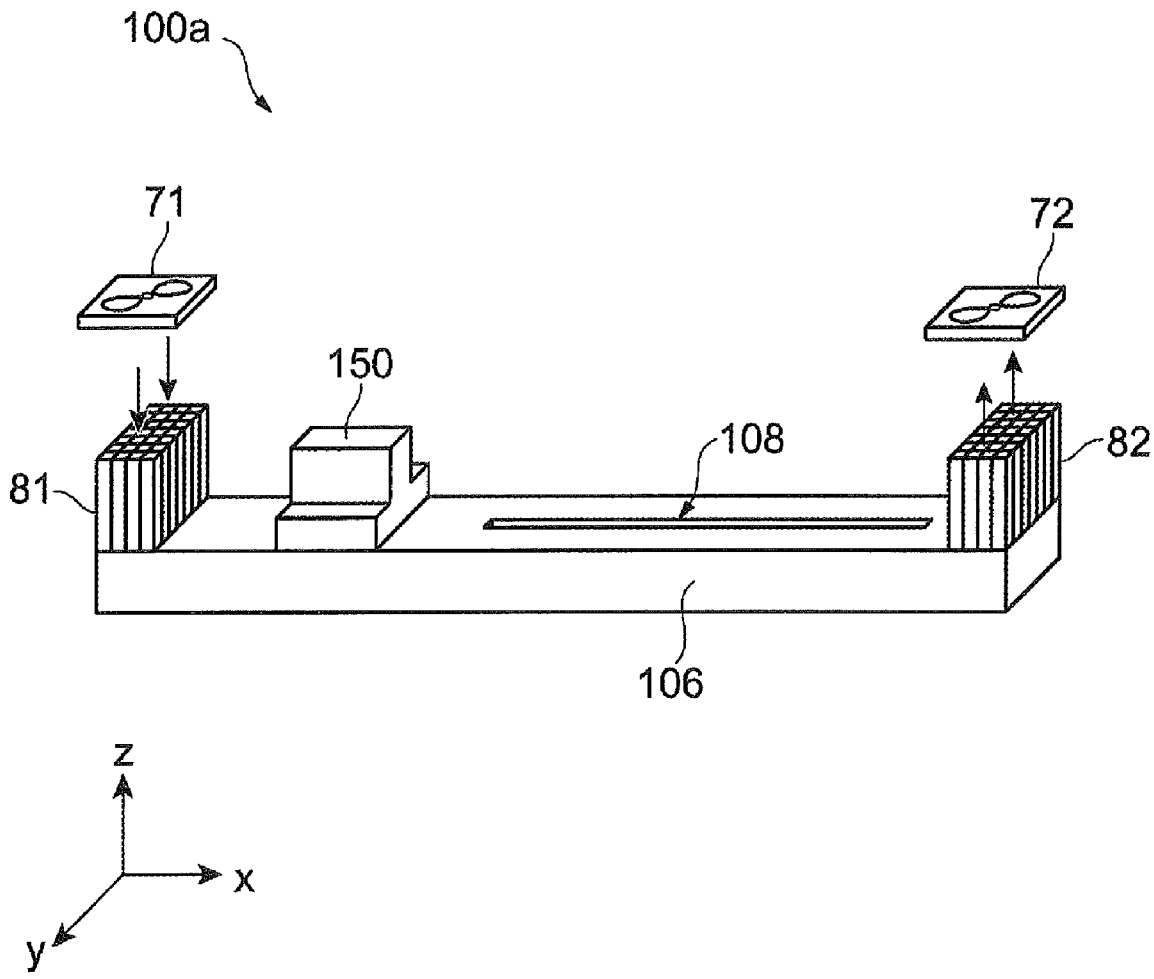
FIG. 3 is a perspective view schematically showing a wave guide according to the first embodiment.

FIG. 3 is a schematic perspective view showing the wave guide according to the first embodiment. As shown in FIG. 3, in this embodiment, the wave guide 100*a* is structured to allow air to flow in the wave guide 100*a* along the longitudinal direction (the running direction of the electromagnetic waves from the magnetron 150) of the wave guide 100*a* shown by the illustrated X-axis direction. On the side of the wave guide 100*a* where the magnetron 150 is attached, the air sending port 81 and the air sending fan 71 are disposed. On the side of the wave guide 100*a* opposite to the side where the magnetron 150 is attached, the air suction port 82 and the air suction fan 72 are disposed. Accordingly, air flows in the same direction as the running direction of the electromagnetic waves in the guide wave 100*a*.

Figure 4:
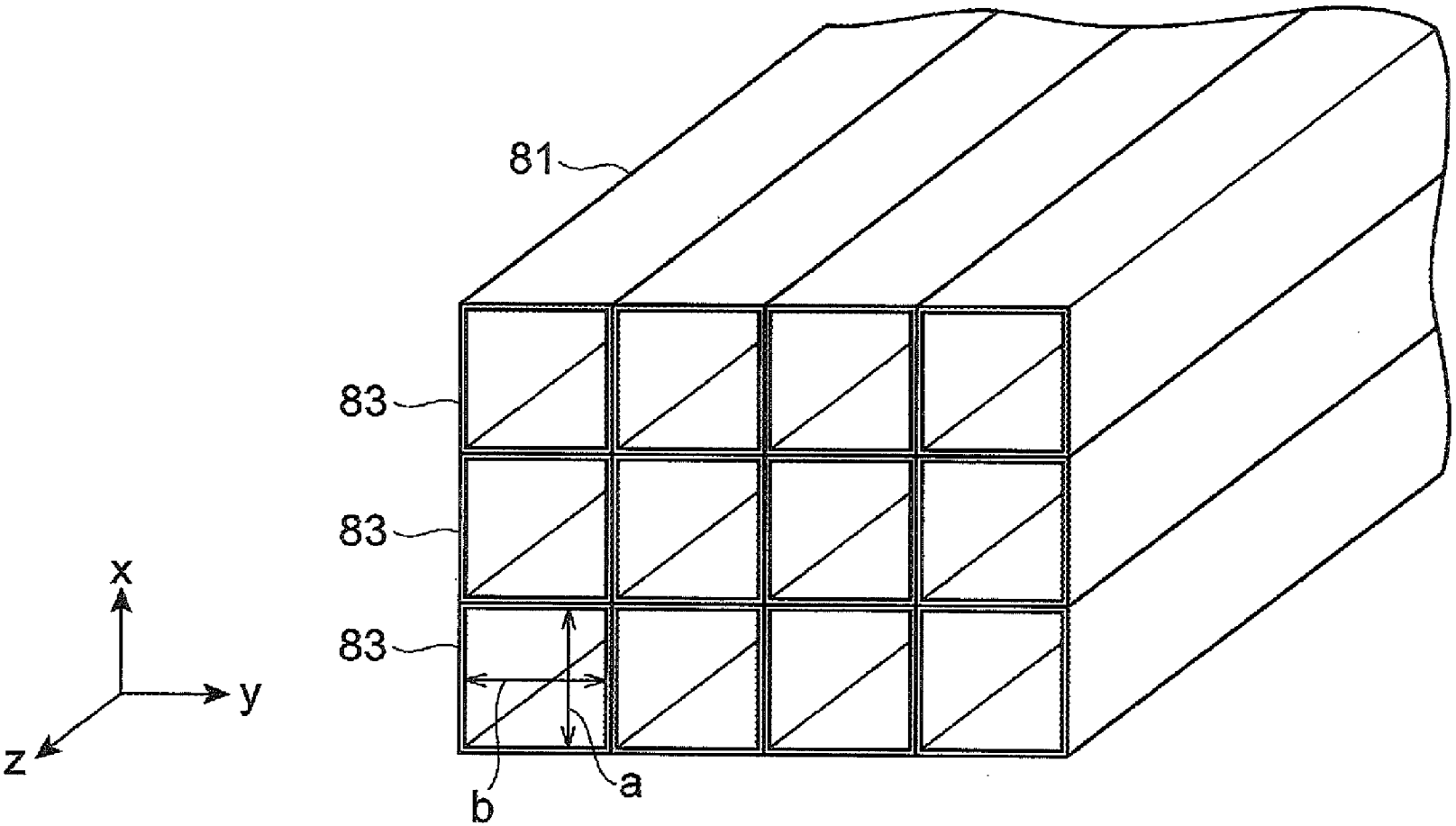
FIG. 4 is an enlarged perspective view showing an air sending port shown in FIG. 3.

FIG. 4 is an enlarged perspective view showing the air sending port 81 shown in FIG. 3. As shown in FIG. 4, the air sending port 81 has a plurality of square tubes 83. Lengths "a" and "b" of inner walls of each square tube 83 are set to satisfy an equation $\lambda>1/\{(m/2a)^2+(n/2b)^2\}^{1/2}$ under condition that the wavelength of the electromagnetic waves supplied from the magnetron 150 is $\lambda$ and the transfer mode of the electromagnetic waves in the wave guide 100*a* is TMmn. That is, a wave passage formed by each square tube 83 is structured to have a cutoff wavelength smaller than the wavelength $\lambda$ of the electromagnetic waves supplied from the magnetron 150. For example, when the lengths of the inner walls of each square tube are set to be a=b=0.02 (m) and the transfer mode of the electromagnetic waves supplied to the wave guide 100*a* is $TM_{10}$, the cutoff wavelength is $\lambda c=0.04$ (m) and the cutoff frequency is about 7.5 GHz. Therefore, when the frequency of the electromagnetic waves supplied to the wave guide 100*a* from the magnetron 150 is smaller than 7.5 GHz, the cutoff wavelength $\lambda c$ of the square tube 83 must be smaller than the wavelength $\lambda$ of the electromagnetic waves supplied from the magnetron 150. The air suction port 82 has the same structure as the aforementioned air sending port 81.

In the operation of the inkjet printer 10, an inkjet head 26 ejects ink onto the surface of the medium 50 so as to conduct printing. The magnetron 150 supplies electromagnetic waves into the wave guide 100*a*. The air sending fan 71 and the air suction fan 72 flow air within the wave guide 100*a*. The rollers 20, 22 feed the medium 50, on which ink is deposited, into the wave guide 100*a* in which air is flowed.

Since this embodiment includes the inkjet head 26 which ejects ink onto the medium 50 and the wave guide 100*a* which is structured to allow the medium 50 on which the ink is deposited by the inkjet head 26 to pass through the inside thereof, and the magnetron 150 which supplies electromagnetic waves into the wave guide 100*a*, the electromagnetic waves supplied to the wave guide 100*a* enable effective drying of the medium 50 after being printed by uninterrupted processes.

According to this embodiment, the air sending fan 71 and the air suction fan 72 flow air in the wave guide 100*a*. Therefore, when moisture in the ink deposited on the medium 50 is evaporated by the electromagnetic waves, the moisture vapor is discharged from the wave guide with the air flowed in the wave guide 100*a*, thereby preventing the drying efficiency from being deteriorated by that the moisture absorbs the energy of electromagnetic waves and thus improving the drying efficiency of the medium 50.

According to this embodiment, since the air sending fan 71 and the air suction fan 72 flow air along the longitudinal direction of the wave guide 100*a*, the flowing of air in the wave guide 100*a* is relatively easily achieved, thereby making the apparatus structure simple with reduced number of the air sending fan 71 and the air suction fan 72.

In addition, in this embodiment, air flows from the side of supplying electromagnetic waves in the running direction of the electromagnetic waves in the wave guide 100*a*, whereby moisture vapor evaporated from the ink deposited on the medium 50 is moved apart from the magnetron 150. Therefore, it is possible to reduce the possibility of spark caused by deposition of moisture on an antenna of the magnetron 150. Especially in this embodiment, the air sending fan 71 is disposed on a side of the magnetron 150 opposite to the running side of the electromagnetic waves in the wave guide 100*a*, thereby preventing the works of the air sending fan 71 from being damaged due to the electromagnetic waves from the magnetron 150.

On the other hand, in this embodiment, the air sending fan 71 at one end of the wave guide 100*a* sends air and the air suction fan 72 at the other end of the wave guide 100*a* sucks air so as to flow air between the both ends of the wave guide 100*a*, thereby enabling air to effectively flow in the wave guide 100*a*.

Further, in this embodiment, the air sending port 81 through which air sent from the air sending fan enters and the air suction port 82 through which air sucked by the air suction fan 72 exits include a plurality of square tubes 83 and the lengths "a" and "b" of the inner walls of each square tube 83 in a section substantially perpendicular to the flowing direction of the air are set to satisfy an equation $\lambda>1/\{(m/2a)^2+(n/2b)^2\}^{1/2}$ under condition that the wavelength of the electromagnetic waves supplied from the magnetron 150 is $\lambda$ and the transfer mode of the electromagnetic waves in the wave guide 100*a* is TMmn, that is, the lengths are set to be less than the cutoff wavelength, thereby preventing the electromagnetic waves from leaking out through the air sending port 81 and the air suction port 82.

The inkjet printer 10 of this embodiment can print on a sheet-like medium 50 made of paper, silk, cotton, vinyl chloride or the like with dye-type ink such as acid dye, reactive dye, and substantive dye or pigment-type ink containing organic solvent such as solvent ink, and uninterruptedly dry the medium 50.

In case of using aqueous ink or solvent ink relative to the sheet-like medium made of paper, silk, cotton, vinyl chloride or the like, acid dye or reactive dye as dye-type ink infiltrates into fibers of the medium 50 and reacts in the fibers, thereby staining the medium 50. Therefore, the reaction of the ink in the fibers of the medium 50 is promoted by electromagnetic waves supplied to the medium 50 through the wave guide 100*a* like the aforementioned embodiment, thereby improving the drying speed.

Solvent ink as pigment-type ink of an organic solvent type contains a resin therein so that the surface of the medium 50 is stained by the resin. Therefore, the drying of the moisture contained in the resin of the solvent ink is promoted by electromagnetic waves supplied to the medium 50 through the wave guide 100*a*, thereby improving the drying speed.

On the other hand, substantive dye as a dye-type ink does not infiltrate into fibers of the medium 50 and stains the medium 50 just by that the ink is deposited on the surface of the medium 50. However, even in case of the substantive dye, if a resin is contained in the ink, the drying of moisture in the resin is promoted. Accordingly, like the aforementioned embodiment, the drying speed is improved by supplying electromagnetic waves to the medium 50 through the wave guide 100*a*.

Figure 5:
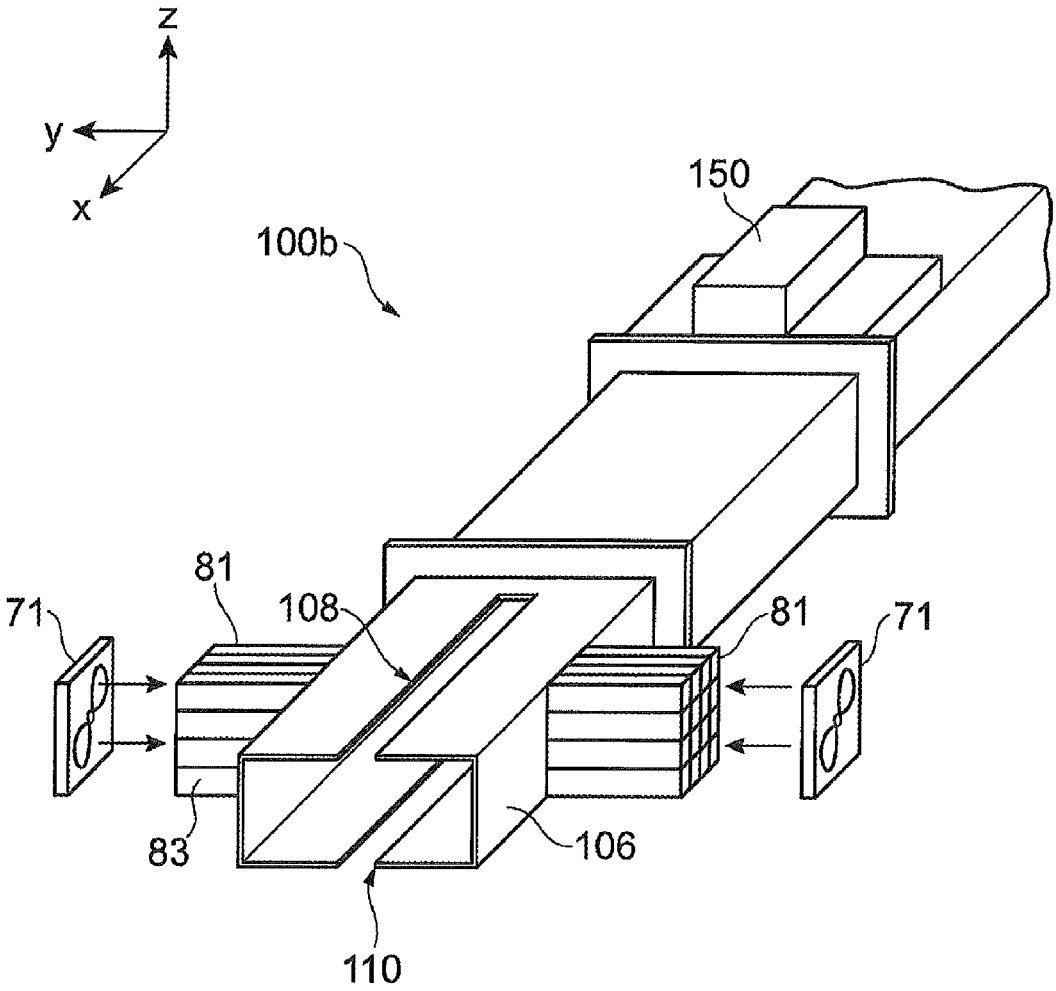
FIG. 5 is a perspective view showing a wave guide according to a second embodiment of the present invention.

Hereinafter, a second embodiment of the present invention will be described. FIG. 5 is a perspective view showing a wave guide according to the second embodiment. As shown in FIG. 5, this embodiment is different from the aforementioned first embodiment in that air is flowed in a direction substantially perpendicular to the surface of the medium 50 passing through the wave guide 100*b*, i.e. in the illustrated Y-axis direction.

As shown in FIG. 5, two air sending fans 71 and two air sending ports 81 similar to those in the first embodiment are arranged along the illustrated Y-axis direction. Each of the air sending portions 81 includes square tubes 83 similar to those of the first embodiment. Though the illustrated example is adapted to send air perpendicularly relative to both the front and back surfaces of the medium 50 passing through the wave guide 100*b*, i.e. in the illustrated Y-axis direction, two air suction fans 72 and two air suction ports 82 similar to those in the first embodiment may be arranged along the illustrated Y-axis direction to suck air perpendicularly relative to both the front and back surfaces of the medium 50 passing through the wave guide 100*b*, i.e. in the illustrated Y-axis direction. In these cases, air is flowed equally relative to the front and back surfaces of the medium 50, thereby preventing the wobble of the medium 50.

Alternatively, air sending fans 71 and air sending ports 81 or air suction fans 72 and air suction ports 82 may be provided only on a side of the medium 50 on which ink is deposited by the inkjet head 26 so as to flow air only one side of the medium 50. In this case, it is possible to efficiently remove moisture evaporated from the medium 50 only by a reduced number of the air sending fans 71 or the air suction fans 72.

There are a plurality of air sending fans 71 and air sending ports 81 or a plurality of air suction fans 72 and air sending port 82 which are aligned along the longitudinal direction of the wave guide 100*b* shown by the illustrated X-axis direction according to the width of the medium 50.

During the operation of the inkjet printer 10 of this embodiment, air supplied from the air sending ports 81 is supplied vertically to the front or back surface of the medium 50 and is discharged out of the wave guide 100*b* through the medium introduction portion 108 or the medium exit portion 110. On the other hand, as air is sucked through the air suction ports 82, air is introduced into the wave guide 100*b* along the front or back surface of the medium 50 through the medium introduction portion 108 and the medium exit portion 110 and moisture is discharged out of the wave guide 100*b* vertically relative to the front or back surface of the medium 50.

In this embodiment, air is flowed vertically against the medium 50 on which ink is deposited, thereby improving the effect of removing the moisture vaporized from the medium 50.

Figure 6:
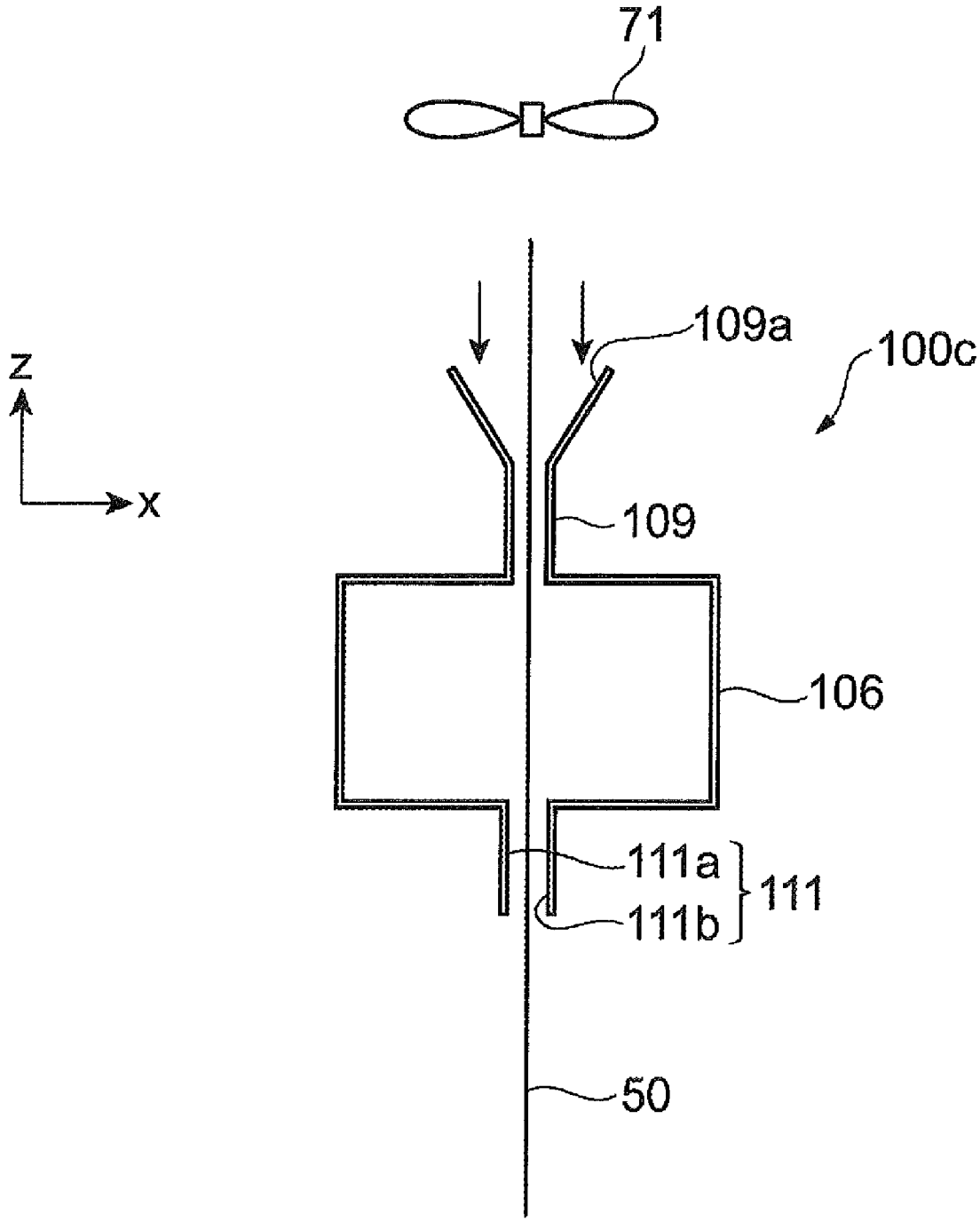
FIG. 6 is a sectional view of a wave guide according to a third embodiment of the present invention, taken along the X-Z plane.

Hereinafter, a third embodiment of the present invention will be described. FIG. 6 is a sectional view of a wave guide according to the third embodiment, taken along the X-Z plane. As shown in FIG. 6, in this embodiment, the air sending fan 71 is different from that of the first embodiment in that air is flowed in the feeding direction of a medium 50 in a wave guide 100*c*. An air sending fan 71 is disposed directly above a medium introduction portion 109. The medium introduction portion 109 has a tapered portion 109*a* of which width is reduced toward the inside of the wave guide 100*c*. Air sent from the air sending fan 71 is effectively converged by the tapered portion 109*a* and is introduced into the wave guide 100*c*. The introduced air is led out through a medium exit portion 11 composed of medium exit walls 111*a*, 111*b* parallel to the front and back surfaces of the medium 50, respectively. Similarly to the medium introduction portion 109, the medium exit portion 11 having a tapered portion of which width is reduced toward the inside of the wave guide 100*c* may be provided and an air sending fan 71 may be disposed directly below the medium exit portion 11 to flow air in a direction toward the side where the medium 50 enters into the wave guide 100*c* from the side where the medium 50 exits the wave guide 100*c*.

In this embodiment, since air flows along the feeding direction of the medium 50 in the wave guide 100*c*, stable feeding of the sheet-like medium 50 in the wave guide 100*c* is enabled by the introduced air. This prevents the medium 50 from wobbling, thus preventing the medium 50 from touching the wave guide 100*c* and preventing disorder in electric field within the wave guide 100*c*.

Especially in this embodiment, since air flows in a direction from the side where the medium 50 enters into the wave guide 100*c* toward the side where the medium 50 exits the wave guide 100*c*, the flowing of air effectively reduces the wobble of the medium 50.

According to an embodiment of the present invention, an inkjet printer includes: an ejection means for ejecting ink onto either one of front and back surfaces of a sheet-like recording medium; a wave guide which is adapted to allow the recording medium on which the ink is deposited by the ejection means to pass through the inside of the wave guide; an electromagnetic-wave supplying means for supplying electromagnetic waves into the wave guide; and a gas sending means for flowing gas in the wave guide.

Since this structure includes the ejection means for ejecting ink onto the recording medium, the wave guide which is adapted to allow the recording medium on which the ink is deposited by the ejection means to pass through the inside thereof, and the electromagnetic-wave supplying means for supplying electromagnetic waves into the wave guide, it is possible to effectively dry the recording medium after being printed by uninterrupted processes with the electromagnetic waves supplied into the wave guide.

Further according to this structure, the gas sending means flows gas in the wave guide. When moisture in the ink deposited on the recording medium is evaporated by the electromagnetic waves, the moisture vapor is discharged out of the wave guide by the gas flowed in the wave guide, thereby preventing the drying efficiency from being deteriorated by that the moisture absorbs the energy of electromagnetic waves and thus improving the drying efficiency of the recording medium.

In this case, the gas sending means may be adapted to flow the gas along the longitudinal direction of the wave guide.

According to this structure, since the gas sending means flows the gas along the longitudinal direction of the wave guide, the flowing of gas in the wave guide is relatively easily achieved, thereby making the apparatus structure simple with reduced number of the gas sending means.

In this case, it is preferable that the gas sending means flows the gas from a side where the electromagnetic-wave supplying means supplies the electromagnetic waves in the longitudinal direction of the wave guide to a side to which the electromagnetic waves run in the wave guide.

According to this structure, gas flows from the side where the electromagnetic-wave supplying means supplies electromagnetic waves in the longitudinal direction of the wave guide to the side to which the electromagnetic waves run in the wave guide, whereby moisture vapor evaporated from the ink deposited on the recording medium is moved apart from the electromagnetic-wave supplying means. Therefore, it is possible to reduce the possibility of spark caused by the moisture.

In addition, it is preferable that the gas sending means flows the gas by sending the gas at one end in the longitudinal direction of the wave guide and sucking the gas at the other end in the longitudinal direction of the wave guide.

According to this structure, gas is sent from one end of the wave guide and is sucked at the other end of the wave guide so that the gas is flowed between the both ends of the wave guide, thereby enabling the gas to effectively flow in the wave guide.

On the other hand, the gas sending means may be adapted to flow the gas vertically relative to either one of the front and back surfaces of the recording medium passing through the inside of the wave guide.

According to this structure, the gas is flowed vertically relative to the recording medium on which the ink is deposited, thereby improving the effect of removing the moisture evaporated from the recording medium.

In this case, the gas sending means may be adapted to flow the gas against one of the front and back surfaces of the recording medium such that the one is the surface on which the ink is deposited by the ejection means.

According to this structure, the gas sending means flows the gas against one of the front and back surfaces of the recording medium such that the one is the surface on which the ink is deposited by the ejection means, thereby efficiently removing moisture evaporated from the recording medium only by a reduced number of the gas sending means.

Further, it is preferable that the wave guide has a gas sending port through which the gas from the gas sending means enters and a gas exit port through which the gas from the gas sending means exits, that the gas sending port and the gas exit port each have a square tube or a plurality of square tubes allowing the gas to flow through the inside thereof, and that lengths "a" and "b" of inner walls of each square tube in a section substantially perpendicular to the flowing direction of the gas are set to satisfy an equation $\lambda>1/\{(m/2a)^2+(n/2b)^2\}^{1/2}$ under condition that the wavelength of the electromagnetic waves supplied from the electromagnetic-wave supplying means is $\lambda$ and the transfer mode of the electromagnetic waves in the wave guide is TMmn.

According to this structure, the gas sending port through which the gas from the gas sending means enters and the gas exit port through which the gas from the gas sending means exits each have square tubes, and lengths "a" and "b" of inner walls of each square tube in a section substantially perpendicular to the flowing direction of the gas are set to satisfy an equation $\lambda>1/\{(m/2a)^2+(n/2b)^2\}^{1/2}$ under condition that the wavelength of the electromagnetic waves supplied from the electromagnetic-wave supplying means is $\lambda$ and the transfer mode of the electromagnetic waves in the wave guide is TMmn, that is, the lengths are set to be less than the cutoff wavelength, thereby preventing the electromagnetic waves from through the gas sending port and the gas exit port.

On the other hand, it is preferable that the gas sending means flows the gas along the feeding direction of the recording medium in the wave guide.

According to this structure, since the gas flows along the feeding direction of the recording medium in the wave guide, stable feeding of the sheet-like recording medium in the wave guide is enabled by the introduced gas. This prevents the recording medium from wobbling, thus preventing the recording medium from touching the wave guide and preventing disorder in electric field within the wave guide.

In this case, it is preferable that the gas sending means flows the gas in a direction from a side where the recording medium enters into the wave guide to a side where the recording medium exits the wave guide.

According to this structure, since the gas flows in the direction from the side where the recording medium enters into the wave guide to the side where the recording medium exits the wave guide, the flowing of air effectively reduces the wobble of the recording medium.

Moreover, according to an embodiment of the present invention, a printing method includes: a step in which an ejecting means ejects ink onto either one of front and back surfaces of a sheet-like recording medium; a step in which an electromagnetic-wave supplying means supplies electromagnetic waves into a wave guide which is adapted to allow the recording medium on which the ink is deposited by the ejection means to pass through the inside of the wave guide; a step in which a gas sending means flows gas in the wave guide; and a step in which the recording medium on which the ink is deposited by the ejection means is fed to pass through the inside of the wave guide in which electromagnetic waves are supplied by the electromagnetic-wave supplying means and gas is flowed by the gas sending means.

According to the embodiment of the present invention, the drying efficiency of a recording medium can be improved.

The present invention is not limited to the aforementioned embodiments and it should be understood that various changes and modifications may be made without departing from the scope of the invention. For example, though examples of sending air into the wave guide have been mainly described in the embodiments, noble gas or the like may be flowed in the wave guide.

What is claimed as new and desired to be secured by letters patent of the united states is:

1. An inkjet printer comprising:

an inkjet head configured to eject ink onto a surface of a medium;

an electromagnetic-wave supplier configured to generate electromagnetic waves;

a wave guide having an internal space into which the medium is to be fed, the wave guide being connected to the electromagnetic-wave supplier to apply the electromagnetic waves to the medium; and a ventilator configured to flow a gas in the internal space of the wave guide, wherein the ventilator is configured to flow the gas along a longitudinal direction of the wave guide, wherein the ventilator comprises an inlet and an outlet, each of the inlet and the outlet comprising a plurality of square tubes, each of the plurality of square tubes extending along a gas flowing direction therein and being defined by a first wall and a second wall orthogonal to the first wall in a cross section substantially perpendicular to the gas flowing direction, and wherein length "a" of the first wall and length "b" of the second wall in the cross section satisfy an equation $\lambda>1/\{(m/2a)^2+(n/2b)^2\}^{1/2}$ where "$\lambda$" is a wavelength of the electromagnetic waves supplied from the electromagnetic-wave supplier and where "m" and "n" are defined in transfer mode "TMmn" of the electromagnetic waves in the wave guide.

2. An inkjet printer comprising:

an inkjet head configured to eject ink onto a surface of a medium;

an electromagnetic-wave supplier configured to generate electromagnetic waves;

a wave guide having an internal space into which the medium is to be fed, the wave guide being connected to the electromagnetic-wave supplier to apply the electromagnetic waves to the medium; and a ventilator configured to flow a gas in the internal space of the wave guide, wherein the ventilator is configured to flow the gas along a longitudinal direction of the wave guide, wherein the ventilator is configured to send the gas into the wave guide at the first end and to suck the gas from the wave guide at the second end, wherein the ventilator comprises an inlet and an outlet, each of the inlet and the outlet comprising a plurality of square tubes, each of the plurality of square tubes extending along a gas flowing direction therein and being defined by a first wall and a second wall orthogonal to the first wall in a cross section substantially perpendicular to the gas flowing direction, and wherein length "a" of the first wall and length "b" of the second wall in the cross section satisfy an equation $\lambda>1/\{(m/2a)^2+(n/2b)^2\}^{1/2}$ where "λ" is a wavelength of the electromagnetic waves supplied from the electromagnetic-wave supplier and where "m" and "n" are defined in transfer mode "TMmn" of the electromagnetic waves in the wave guide.

3. An inkjet printer comprising:

an inkjet head configured to eject ink onto a surface of a medium;

an electromagnetic-wave supplier configured to generate electromagnetic waves;

a wave guide having an internal space into which the medium is to be fed, the wave guide being connected to the electromagnetic-wave supplier to apply the electromagnetic waves to the medium; and a ventilator configured to flow a gas in the internal space of the wave guide, wherein the ventilator is configured to flow the gas in a direction substantially perpendicular to the surface of the medium, wherein the ventilator comprises an inlet and an outlet, each of the inlet and the outlet comprising a plurality of square tubes, each of the plurality of square tubes extending along a gas flowing direction therein and being defined by a first wall and a second wall orthogonal to the first wall in a cross section substantially perpendicular to the gas flowing direction, and wherein length "a" of the first wall and length "b" of the second wall in the cross section satisfy an equation $\lambda>1/\{(m/2a)^2+(n/2b)^2\}^{1/2}$ where "λ" is a wavelength of the electromagnetic waves supplied from the electromagnetic-wave supplier and where "m" and "n" are defined in transfer mode "TMmn" of the electromagnetic waves in the wave guide.

4. An inkjet printer comprising:

an inkjet head configured to eject ink onto a surface of a medium;

an electromagnetic-wave supplier configured to generate electromagnetic waves;

a wave guide having an internal space into which the medium is to be fed, the wave guide being connected to the electromagnetic-wave supplier to apply the electromagnetic waves to the medium; and a ventilator configured to flow a gas in the internal space of the wave guide, wherein the ventilator is configured to flow the gas in a direction substantially perpendicular to the surface of the medium, wherein the surface of the medium comprises a first surface and a second surface opposite to the first surface, the ink being ejected on the first surface, wherein the ventilator is configured to send the gas to the first surface of the medium, wherein the ventilator comprises an inlet and an outlet, each of the inlet and the outlet comprising a plurality of square tubes, each of the plurality of square tubes extending along a gas flowing direction therein and being defined by a first wall and a second wall orthogonal to the first wall in a cross section substantially perpendicular to the gas flowing direction, and wherein length "a" of the first wall and length "b" of the second wall in the cross section satisfy an equation $\lambda>1/\{(m/2a)^2+(n/2b)^2\}^{1/2}$ where "λ" is a wavelength of the electromagnetic waves supplied from the electromagnetic-wave supplier and where "m" and "n" are defined in transfer mode "TMmn" of the electromagnetic waves in the wave guide.

* * * * *